US010119363B2

(12) United States Patent
Cleven

(10) Patent No.: US 10,119,363 B2
(45) Date of Patent: Nov. 6, 2018

(54) METHODS AND SYSTEMS FOR A PRESSURE CONTROLLED PISTON SLEEVE

(71) Applicant: COMITT WELL SOLUTIONS US HOLDING INC., Katy, TX (US)

(72) Inventor: Peter Kris Cleven, Grand-Barachois (CA)

(73) Assignee: Comitt Well Solutions LLC, Katy, TX (US)

( * ) Notice: Subject to any disclaimer, the term of this patent is extended or adjusted under 35 U.S.C. 154(b) by 120 days.

(21) Appl. No.: 15/343,519

(22) Filed: Nov. 4, 2016

(65) Prior Publication Data

US 2018/0128079 A1 May 10, 2018

(51) Int. Cl.
*E21B 34/10* (2006.01)
*E21B 43/26* (2006.01)
*E21B 34/00* (2006.01)

(52) U.S. Cl.
CPC ..... *E21B 34/10* (2013.01); *E21B 43/26* (2013.01); *E21B 2034/007* (2013.01)

(58) Field of Classification Search
CPC ..... E21B 34/10; E21B 34/06; E21B 43/12; E21B 43/26; E21B 2034/007
See application file for complete search history.

(56) References Cited

U.S. PATENT DOCUMENTS

| | | | | |
|---|---|---|---|---|
| 4,574,894 | A | 3/1986 | Jadwin | |
| 2011/0198096 | A1* | 8/2011 | Mailand | E21B 34/14 166/373 |
| 2013/0025872 | A1 | 1/2013 | Mailand et al. | |
| 2015/0308250 | A1* | 10/2015 | Anders | E21B 33/12 166/308.2 |
| 2016/0115767 | A1 | 4/2016 | Watson | |
| 2016/0230507 | A1 | 8/2016 | Cleven | |
| 2017/0030173 | A1* | 2/2017 | MacPhail | E21B 43/38 |

* cited by examiner

*Primary Examiner* — Yong-Suk Ro

(74) *Attorney, Agent, or Firm* — Pierson IP, PLLC

(57) ABSTRACT

The present application describes methods and systems for a tool with a new check valve. The check valve may include a piston sleeve that is configured to move towards the proximal end of the tool to seal restrictive ports in a center of the tool responsive to creating a force on the piston sleeve. In embodiments, the movement of the piston sleeve may be counter to the flow of fluid through an inner diameter of the tool, such that the tool may be resettable and repeatable based on fluid flow and/or pressure differentials and not based on drag force through an inner diameter of the tool.

20 Claims, 3 Drawing Sheets

METHODS AND SYSTEMS FOR A PRESSURE CONTROLLED PISTON SLEEVE

BACKGROUND INFORMATION

Field of the Disclosure

Examples of the present disclosure relate to systems and methods for a piston sleeve within a tool that is configured to move based on a pressure differential. Specifically, embodiments disclose a piston sleeve configured to move based on a pressure differential and a linear force.

Background

Hydraulic injection is performed by pumping fluid into a geological formation at a pressure sufficient to create fractures in the formation. When a fracture is open, a propping agent may be added to the fluid. The propping agent, e.g. sand or ceramic beads, remains in the fractures to keep the fractures open when the pumping rate and pressure decreases.

Conventionally, to generate sufficient pressure to create the fractures in the formations, systems utilize packers to isolate zones of interest. The packers are typically set by using a valve to seal a distal end of a tool due to drag force within the tool. More specifically, the valve in the tool seals the distal end of the tool by flowing liquid over the valve, and moving the valve towards the distal end of the tool. Furthermore, in conventional systems, if fluid flows into the distal end of the tool, the valve will no longer seal the tool, causing the packers to become unset. However, situations may arise where it may not be desirable to set the tool based on a drag force through the tool.

Accordingly, needs exist for system and methods for a tool with a piston sleeve that is configured to set the tool based on a pressure differential and a linear force.

SUMMARY

Embodiments disclosed herein describe fracturing methods and systems for a tool with a new check valve. The check valve may include a piston sleeve that is configured to move towards the proximal end of the tool to seal restrictive ports in a center of the tool responsive to creating a force on the piston sleeve. In embodiments, the movement of the piston sleeve may be counter to the flow of fluid through an inner diameter of the tool, such that the tool may be resettable and repeatable based on fluid flow and/or pressure differentials and not based on drag force through an inner diameter of the tool.

Embodiments may include a tool with an inner diameter, a piston sleeve, restrictive ports, a linear adjustable member positioned within a first pressure chamber, a filter, and a second pressure chamber communicatively coupled with an annulus via vents.

The inner diameter of the tool may be a hollow chamber extending from a proximal end of the tool to the distal end of the tool. In an open configuration, the fluid may able to flow from the proximal end of the tool to the distal end of the tool, and vice versa. Accordingly, the tool may be configured to allow for bidirectional fluid flow through the inner diameter. However, fluid flowing from the distal end of the tool to the proximal end of the tool will not cause the tool to be set in a closed configuration.

A piston sleeve may be configured to be a lower internal sleeve within the inner diameter of the tool. The piston sleeve may be configured to move towards the proximal end of the tool to cover the restrictive ports responsive to fluid flowing from the proximal end of the tool towards the distal end of the tool. The piston sleeve may be configured to move based on a pressure differential between a first pressure chamber and a second pressure chamber, as well as a linear force applied by the linear adjustable member.

The restrictive ports may be holes that are centrally located within the tool. In the open configuration, the restrictive ports may not be covered, allowing fluid to flow through the tool. In the closed configuration, the restrictive ports may be covered, restricting the flow of fluid through the tool while the restrictive ports are opened, the first pressure zones and the second pressure zones may be equalized. However, when the piston sleeve is moved to cover the restrictive ports, a pressure differential between first pressure zones and second pressure zones may be created. In embodiments, the size and quantity of the restrictive ports may be adjusted to control the pressure differential between the first pressure zones and the second pressure zones.

A linear adjustable member, such as a spring, may be positioned within a first pressure chamber. The linear adjustable member may be configured to apply a linear force against the piston, wherein the force is configured to move the piston sleeve towards the distal end of the tool. In embodiments, the linear force may be a predetermined force, which may be adjustable, such as by replacing the spring with a second spring with different characteristics.

The filter may be a passageway that communicatively couples a first pressure chamber with a first pressure zone located on a first side of the restrictive ports. Through this communication, the first pressure chamber may have the same pressure level as the first pressure zone. Responsive to fluid flowing through the inner diameter of the tool, the fluid may flow to the first pressure chamber, which may create a piston force against the piston and linear adjustable member. The filter may also remove debris, which may cause internal jamming in the linear adjustable member and the piston sleeve.

A second pressure chamber may be located between a sealing edge of the piston sleeve and a sealing ledge. The second pressure chamber may be communicatively coupled, via vents, to an inner diameter of the piston sleeve and an annulus.

Responsive to a fluid flowing from the proximal end of the tool towards the distal end of the tool, the pressure within the first pressure zone and the first pressure chamber may increase. The increase in pressure may cause the pressure within the first pressure chamber to become greater than the pressure within the second pressure chamber. This increase in pressure creates a piston force on the linear adjustable member that is greater than that of the predetermined linear force corresponding to the linear adjustable member. When the piston force is greater than the linear force, the piston sleeve may move towards the proximal end of the tool, and cover the restrictive ports. Responsive to covering the restrictive ports, the tool may remain sealed or closed until the piston force is less than or equal to the linear force, which may be caused by decreasing the pressure within the inner diameter of the tool below a threshold such that the piston force becomes lower than that of the linear adjustable member and the valve is released or deactivated.

In embodiments, the vents and/or the restrictive ports are adjustable in quantity, shape, positioning, etc. By adjusting the vents and/or the restrictive ports, constants associated with Bernoulli's Equation may change, allowing for changes to desired flow rates within the inner diameter of the tool to set the tool.

Embodiments may be used as a check valve in other systems where fluid flow throws an inner diameter of a tool.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
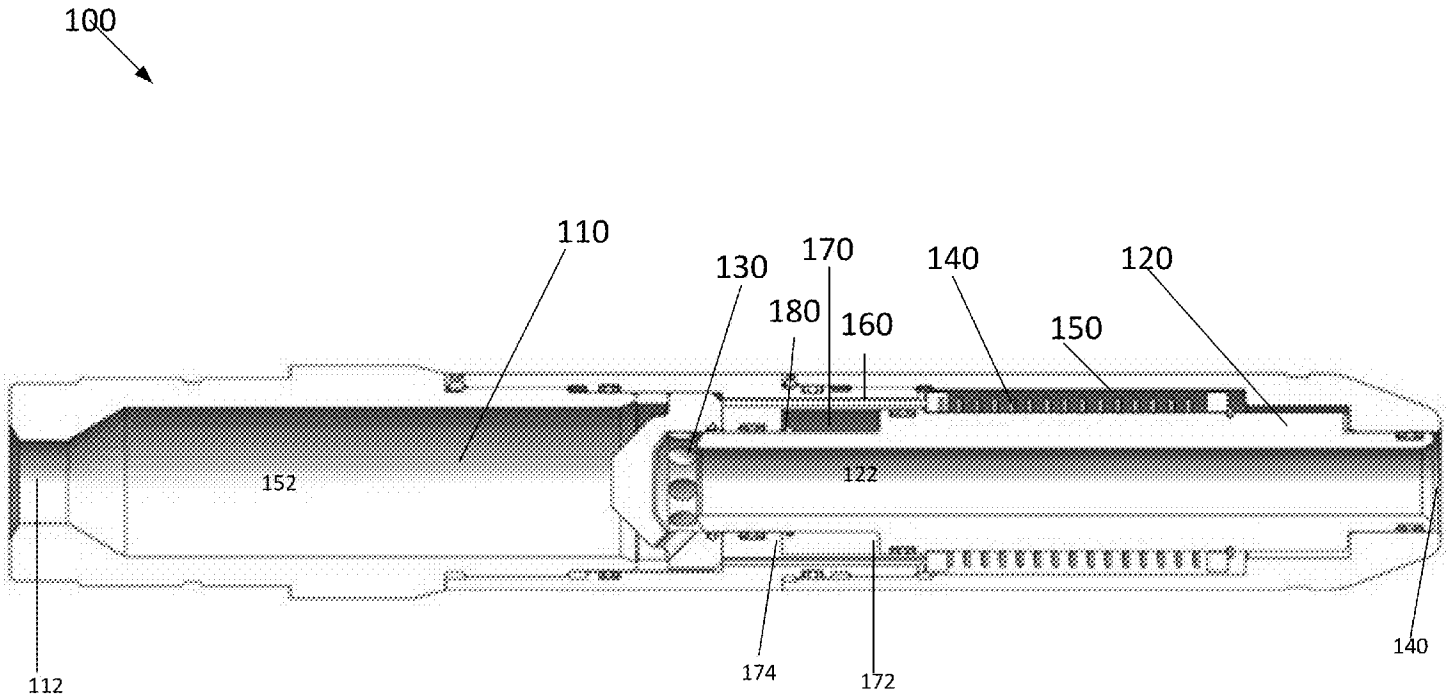
FIG. 1 depicts a tool in an open configuration, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent, however, to one having ordinary skill in the art, that the specific detail need not be employed to practice the present embodiments. In other instances, well-known materials or methods have not been described in detail in order to avoid obscuring the present embodiments.

FIG. 1 depicts a tool 100 in an open configuration, according to an embodiment. Tool 100 may be configured to be a new check valve for fracturing systems and methods. Tool 100 may be resettable and repeatable based on fluid flow and/or pressure differentials, and not based on drag force through an inner diameter 110 of tool 100. Tool 100 may include inner diameter 110, a piston sleeve 120, restrictive ports 130, a linear adjustable member 140 positioned within a first pressure chamber 150, a filter 160, a second pressure chamber 170 communicatively coupled with an annulus via vents 180.

Inner diameter 110 of tool 100 may be a hollow chamber configured to extend from a proximal end 112 of tool 100 to a distal end 114 of tool 100. The hollow chamber may be configured to allow fluid to flow from proximal end 112 to distal end 114, and vice versa. Tool 100 may be configured to be set responsive to flowing fluid from the proximal end 112 towards distal end 114 of tool 100 at a flow rate above a pressure threshold. When the tool is set, packers, sealing agents, or other elements of tool 100 may be deployed or activated. Yet, tool 100 may not be set responsive to flowing fluid from distal end 114 towards proximal end 112 of tool 100.

Piston sleeve 120 may be a device that is configured to be positioned within inner diameter of tool 100. Piston sleeve 120 may be configured to be encompassed by inner diameter 110, such that piston sleeve 120 has a smaller diameter than that of inner diameter 110. Piston sleeve 120 may be configured to move based on a pressure differential between first pressure chamber 150 and second pressure chamber 170, as well as a linear force applied by linear adjustable member 140. Piston sleeve 120 may be configured to move in a direction that is in parallel to a longitudinal axis of tool 100. In a closed configuration, piston sleeve 120 may be configured to move towards proximal end 112 of tool 100, such that the first end of piston sleeve 120 covers restrictive ports 130. Piston sleeve 120 may be configured to move towards distal end 114 of tool 100 to uncover restrictive ports 130. In an open position, a first end of piston sleeve 120 may not be overlapping with restrictive ports 130.

Restrictive ports 130 may be ports, valves, openings, etc. positioned between proximal end 112 and distal end 114 of tool 100. Restrictive ports 130 may be configured to control the flow of fluid between proximal end 112 and distal end 114. When restrictive ports 130 are in a closed configuration and are covered by piston sleeve 120, fluid may not flow between proximal end 112 and distal end 114. When restrictive ports 130 are in an open configuration and uncovered, fluid may flow between proximal end 112 and distal end 114. However, if the flow of fluid through the inner diameter is more than can be passed through the restrictive ports based on the flow rate and size/quantity limitations of restrictive ports 130, restrictive ports 130 may dynamically change the pressure differential between first pressure chamber 150 and second pressure chamber 170. Restrictive ports 130 may change from the open configuration to the closed configuration based in part the fluid flow rate through inner diameter 110, which may cause piston sleeve 120 to move. In embodiments, the size, quantity, shape, and/or positioning of restrictive ports 130 may be adjusted to control the pressure differential between the first pressure chamber 150 and second pressure chamber 170.

Linear adjustable member 140 may be a spring, piston, etc. that is configured to move piston sleeve 120 along a linear axis. Linear adjustable member 140 may be configured to compress and/or expand based upon a linear force associated with linear adjustable member 140 and a piston force based on pressure. Linear adjustable member 140 may have a first end that is positioned adjacent to a ledge within inner diameter 110, and a second end that is coupled with an outer diameter of piston sleeve 120. Responsive to linear adjustable member 140 compressing and/or expanding, piston sleeve 120 may be configured to correspondingly move. For example, responsive to linear adjustable member 140 compressing, piston sleeve 120 may move towards proximal end 112, and responsive to linear adjustable member 140 expanding, piston sleeve 120 may move towards distal end 114. In embodiments, linear adjustable member 140 may be configured to constantly apply the linear force against piston sleeve 120. The linear force may be a predetermined, but adjustable force, which is applied in a direction from proximal end 112 towards distal end 114 of tool 100. A pressure level within the first pressure chamber 150 should be greater than the linear force to compress linear adjustable member 140 and correspondingly move piston sleeve 120 into the closed position.

Linear adjustable member 140 may be positioned within a first pressure chamber 150. First pressure chamber 150 may be positioned within a cavity between an outer diameter of piston sleeve 120 and inner diameter 110. The first pressure chamber 150 may have the same pressure as a first pressure zone 152 positioned between the proximal end 112 of tool 110 and restrictive ports 130.

Filter 160 may be a passageway that communicatively couples first pressure chamber 150 with first pressure zone 152 across restrictive ports 130. Accordingly, filter 160 may have a first end that is coupled with first pressure zone 152 and a second end that is coupled with first pressure chamber 150. Utilizing filter 160, a change in pressure within first pressure zone 152 may cause a corresponding change in pressure within first pressure chamber 150. Thus, first pressure zone 152 may have the same pressure as first pressure chamber 150. Responsive to flowing fluid through inner diameter 110 filter 160 may communicate this fluid into first pressure chamber 150, which may correspondingly increase and/or decrease the pressure within first pressure chamber 150 based in part on the fluid flow rate. Filter 160 may also be configured to remove debris flowing through inner diameter 110, which may cause internal jamming in linear adjustable member 140 and/or piston sleeve 120.

A second pressure chamber 170 may be located between a sealing edge 172 of piston sleeve 120 and sealing ledge 174. Sealing edge 172 and sealing ledge 174 may be configured to limit, reduce, or impede pressure within second pressure chamber 170 affecting other areas of tool 100. The second pressure chamber 170 may be communicatively coupled with an annulus via vents 180, wherein the annulus may be positioned between tool 100 and a geological formation.

Vents 180 may be machine drilled holes through tool 100 and a second pressure zone 122 within piston sleeve 120. By communicatively coupling second pressure chamber 170 with the annulus, second pressure chamber 170 may have a pressure that is independent from first pressure chamber 150 when restrictive ports 130 are closed. Furthermore, when restrictive ports 130 are closed, the pressure within piston sleeve 120 may be the same as within second pressure chamber 170. In embodiments, vents 180 may be adjustable in shape, quantity, size, positioning, etc. By adjusting the characteristics of vents 180, constants associated with Bernoulli's Equation and the pressure chambers may change.

Figure 2:
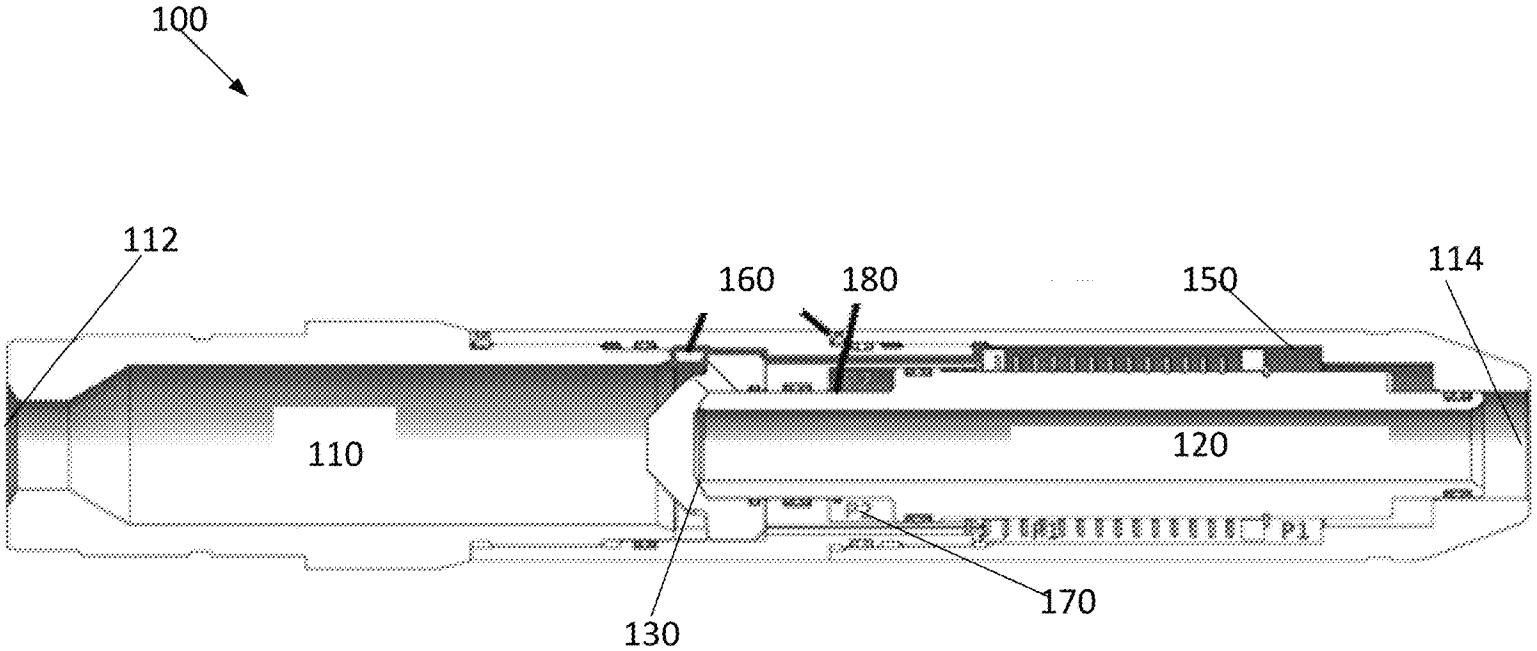
FIG. 2 depicts a tool in a closed configuration, according to an embodiment.

FIG. 2 depicts tool 100 in a closed configuration, according to an embodiment. Elements depicted in FIG. 2 may be substantially similar to those described above. Therefore, for the sake of brevity a further description of these elements is omitted.

As depicted in FIG. 2, piston sleeve 120 has moved towards proximal end 112 of tool 100, such that piston sleeve 120 covers restrictive ports 130. When piston sleeve 120 is in the closed position, fluid may not flow through inner diameter 110 of tool 100. As further depicted in FIG. 2, linear adjustable member 140 is compressed, which allows for the movement of piston sleeve 120 within inner diameter 110. By moving piston sleeve 120, the dimensions of second pressure chamber 170 may change.

Additionally, a pressure within second pressure chamber 170 and within piston sleeve 120 below restrictive ports 130 may remain the same. This may be caused by vents 180 extending through tool 100 and into the annulus and piston sleeve 120. Thus, the pressure within second pressure chamber 170 and piston sleeve 120 may not be affected by the closing of restrictive ports 130.

Figure 3:
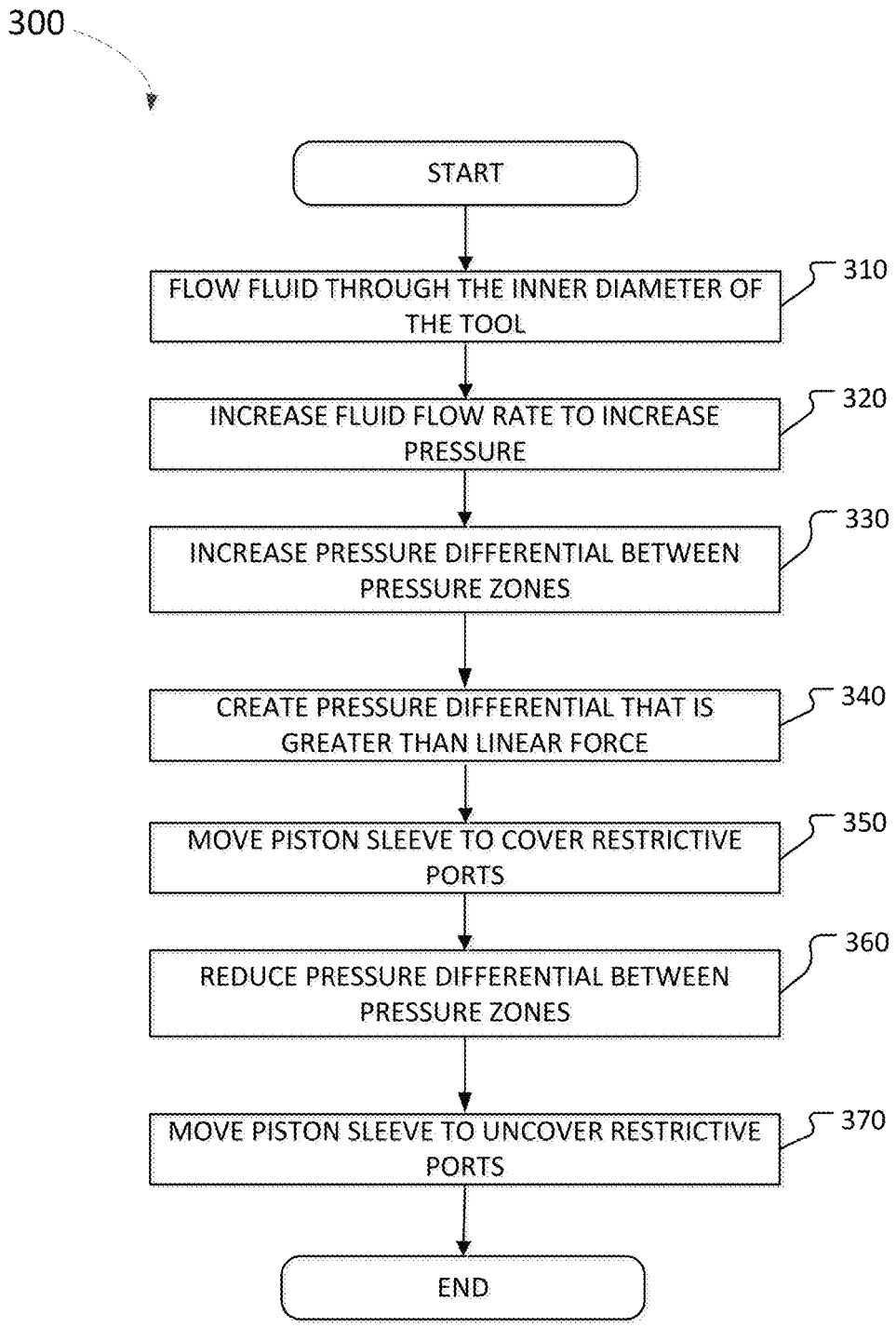
FIG. 3 depicts a method for utilizing a piston sleeve to close restrictive ports, according to an embodiment.

FIG. 3 depicts a method 300 for a new check valve within a tool, according to an embodiment. The operations of method 300 presented below are intended to be illustrative. In some embodiments, method 300 may be accomplished with one or more additional operations not described, and/or without one or more of the operations discussed. Additionally, the order in which the operations of method 300 are illustrated in FIG. 3 and described below is not intended to be limiting. Furthermore, the operations of method 300 may be repeated for subsequent valves or zones in a well.

At operation 310, fluid may flow through the inner diameter of the tool through from the proximal end towards the distal end of the tool, while the tool is in the open configuration. Thus, the fluid may flow through the restrictive ports.

At operation 320, the rate of fluid flowing through the inner diameter of the tool may increase.

At operation 330, the pressure differential between the inner diameter and annulus may increase due to the fluid flow constraints caused by the restrictive ports in the center of the tool. Furthermore, the pressure differential may also be changed within the first pressure chamber and the second pressure chamber.

At operation 340, the pressure differential between the first pressure chamber and the second pressure chamber may be greater than the linear force.

At operation 350, the piston sleeve may move towards the proximal end of the tool and cover the restrictive ports responsive to the pressure differential being greater than the linear force.

At operation 360, the fluid flow rate within the inner diameter of the tool may decrease, such that a pressure within the inner diameter of the tool is less than the linear force At operation 370, responsive to the decrease in pressure within the inner diameter of the tool being less than the linear force, the piston sleeve may move towards the proximal end of the tool, such that the restrictive ports are no longer covered.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale. For example, in embodiments, the length of the dart may be longer than the length of the tool.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A fracturing system comprising:

a tool with an inner diameter extending from a distal end of the tool to a proximal end of the tool;

restrictive ports configured to allow or restrict a flow of fluid through the inner diameter of the tool, the restrictive ports being positioned between the proximal end and the distal end;

a piston sleeve configured to move within the inner diameter of the tool, the piston sleeve being configured to move in an opposite direction of the flow of fluid through the inner diameter of the tool.

2. The system of claim 1, further comprising:

a linear adjustable member positioned within a first pressure chamber and being coupled to the piston sleeve, the linear adjustable member creating a linear force against the piston sleeve in a direction from the proximal end towards the distal end.

3. The system of claim 2, further comprising:

a filter configured to communicatively couple the first pressure chamber with a first pressure zone located between the proximal end and the restrictive ports.

4. The system of claim 3, further comprising:

a second pressure chamber located between the linear adjustable member and the restrictive ports, the second pressure chamber being communicatively coupled to an annulus outside of the tool and a hollow chamber within the piston sleeve.

5. The system of claim 4, wherein the piston sleeve is configured to move based on the pressure within the first pressure chamber, the second pressure chamber, and the linear force.

6. The system of claim 5, wherein a first pressure within the first pressure chamber increases responsive to increasing a fluid flow rate through the inner diameter of the tool while a second pressure within the second pressure chamber remains constant.

7. The system of claim 6, wherein the piston sleeve is configured to move towards the proximal end when a pressure differential between the first pressure chamber and the second pressure chamber is greater than the linear force.

8. The system of claim 5, wherein the piston sleeve is configured to move towards the distal end when a pressure differential between the first pressure chamber and the second pressure chamber is less than or equal to the linear force.

9. The system of claim 5, wherein in an open configuration the piston sleeve does not cover the restrictive ports, and the fluid my flow from the proximal end to the distal end, and vice versa.

10. The system of claim 1, wherein a quantity and size of the restrictive ports is adjustable, wherein changing the quantity and size of the restrictive ports changes a flow rate through the inner diameter required to set the tool.

11. A fracturing method comprising:

positioning a tool within a geological formation, the tool including an inner diameter extending from a distal end of the tool to a proximal end of the tool;

controlling a flow of fluid through the inner diameter of the tool via restrictive ports, the restrictive ports being positioned between the proximal end and the distal end;

moving a piston sleeve within the inner diameter of the tool in an opposite direction of the flow of fluid through the inner diameter of the tool.

12. The method of claim 11, further comprising:

positioning a linear adjustable member within a first pressure chamber;

coupling the linear adjustable member to the piston sleeve;

generating, via the linear adjustable member, a linear force against the piston sleeve in a direction from the proximal end towards the distal end.

13. The method of claim 12, further comprising:

utilizing a filter to remove debris associated with the tool.

14. The method of claim 13, further comprising:

communicatively coupling, via vents, a second pressure chamber to an annulus outside of the tool and a hollow chamber within the piston sleeve, the second pressure chamber being located between the linear adjustable member and the restrictive ports.

15. The method of claim 14, further comprising:

moving the piston sleeve based on the pressure within the first pressure chamber, the second pressure chamber, and the linear force.

16. The method of claim 15, further comprising:

moving the piston sleeve towards the distal end when a pressure differential between the first pressure chamber and the second pressure chamber is less than or equal to the linear force.

17. The method of claim 15, wherein in an open configuration the piston sleeve does not cover the restrictive ports, and the fluid my flow from the proximal end to the distal end, and vice versa.

18. The method of claim 14, further comprising:

increasing a first pressure within the first pressure chamber responsive to increasing a fluid flow rate through the inner diameter of the tool while a second pressure within the second pressure chamber remains constant.

19. The method of claim 18, further comprising:

moving the piston sleeve towards the proximal end when a pressure differential between the first pressure chamber and the second pressure chamber is greater than the linear force.

20. The method of claim 11, wherein a quantity and size of the restrictive ports is adjustable, wherein changing the quantity and size of the restrictive ports changes a flow rate through the inner diameter required to set the tool.

* * * * *